US009869195B2

(12) United States Patent
Miller et al.

(10) Patent No.: US 9,869,195 B2
(45) **Date of Patent: *Jan. 16, 2018**

(54) SUPPORT ASSEMBLY FOR A GAS TURBINE ENGINE

(71) Applicant: United Technologies Corporation, Hartford, CT (US)

(72) Inventors: Andrew S. Miller, Marlborough, CT (US); Peter Balawajder, Vernon, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 302 days.

This patent is subject to a terminal disclaimer.

(21) Appl. No.: 14/715,844

(22) Filed: May 19, 2015

(65) Prior Publication Data

US 2016/0341061 A1 Nov. 24, 2016

(51) Int. Cl.

| | |
|---|---|
| ***F01D 11/14*** | (2006.01) |
| ***F01D 25/28*** | (2006.01) |
| ***F01D 11/18*** | (2006.01) |

(52) U.S. Cl.

CPC ..... *F01D 11/14* (2013.01); *F01D 11/18* (2013.01); *F01D 25/28* (2013.01); *F05D 2220/32* (2013.01); *F05D 2270/305* (2013.01)

(58) Field of Classification Search

CPC ..... F01D 11/08; F01D 11/14; F01D 11/18; F01D 25/28; F05D 2270/305; F05D 2220/32

See application file for complete search history.

(56) References Cited

U.S. PATENT DOCUMENTS

| | | | | |
|---|---|---|---|---|
| 3,937,433 | A * | 2/1976 | Portaleoni | F01D 25/28 248/550 |
| 4,247,248 | A * | 1/1981 | Chaplin | F01D 11/08 415/136 |
| 5,125,796 | A | 6/1992 | Cromer | |
| 5,154,575 | A * | 10/1992 | Bonner | F04D 29/164 415/134 |
| 5,211,535 | A | 5/1993 | Martin et al. | |
| 6,170,831 | B1 | 1/2001 | Bouchard | |
| 7,717,671 | B2 | 5/2010 | Addis | |
| 8,769,963 | B2 | 7/2014 | Ryan | |
| 8,800,133 | B2 | 8/2014 | Caprario et al. | |

(Continued)

FOREIGN PATENT DOCUMENTS

| | | |
|---|---|---|
| WO | 2014052345 | 4/2014 |
| WO | 2014133483 | 9/2014 |

(Continued)

OTHER PUBLICATIONS

Extended European Search Report for European Application No. 16170475.4 dated Oct. 25, 2016.

*Primary Examiner* — Nathaniel Wiehe
*Assistant Examiner* — Elton Wong
(74) *Attorney, Agent, or Firm* — Carlson, Gaskey & Olds, P.C.

(57) ABSTRACT

A support assembly for a gas turbine engine includes a control ring that extends about a circumferential axis. A plurality of first supports has a cavity that receives the control ring. A plurality of cover plates are attached to the first plurality of supports and enclose the cavity.

16 Claims, 3 Drawing Sheets

(56) References Cited

U.S. PATENT DOCUMENTS

| | | | | |
|---|---|---|---|---|
| 8,834,106 | B2 | 9/2014 | Luczak | |
| 2003/0049121 | A1* | 3/2003 | Dierksmeier | F01D 11/18 415/173.1 |
| 2012/0275898 | A1* | 11/2012 | McCaffrey | F01D 11/18 415/1 |
| 2013/0048749 | A1 | 2/2013 | McMahon et al. | |
| 2013/0149143 | A1 | 6/2013 | Gibson | |
| 2013/0323046 | A1 | 12/2013 | Gordon et al. | |
| 2014/0023480 | A1* | 1/2014 | McCaffrey | F01D 11/16 415/47 |
| 2014/0133955 | A1* | 5/2014 | McCaffrey | F01D 9/04 415/1 |
| 2015/0267614 | A1* | 9/2015 | Merlot | F02K 3/06 415/182.1 |
| 2016/0123172 | A1* | 5/2016 | Mondal | F01D 11/025 415/136 |
| 2016/0341062 | A1* | 11/2016 | Jenkins | F01D 11/18 |

FOREIGN PATENT DOCUMENTS

| | | |
|---|---|---|
| WO | 2014200768 | 12/2014 |
| WO | 2015069338 | 5/2015 |

* cited by examiner

SUPPORT ASSEMBLY FOR A GAS TURBINE ENGINE

STATEMENT REGARDING FEDERALLY SPONSORED RESEARCH OR DEVELOPMENT

This invention was made with government support under Contract No.—FA8650-09-D-2923-0021 awarded by the United States Air Force. The Government has certain rights in this invention.

BACKGROUND

Gas turbine engines typically include a fan delivering air into a compressor. The air is compressed in the compressor and delivered into a combustion section where it is mixed with fuel and ignited. Products of this combustion pass downstream over turbine blades, driving them to rotate. Turbine rotors, in turn, drive the compressor and fan rotors.

The efficiency of the engine is impacted by ensuring that the products of combustion pass in as high a percentage as possible across the turbine blades. Leakage around the blades reduces efficiency.

Thus, a blade outer air seal is provided radially outward of the blades to prevent leakage radially outwardly of the blades. The blade outer air seal may be held radially outboard from the rotating blade via connections on the case or a blade outer air seal support structure. The clearance between the blade outer air seal and a radially outer part of the blade is referred to as a tip clearance.

Since the rotating blade and blade outer air seal may respond radially at different rates due to loads, the tip clearance may be reduced and the blade may rub on the blade air outer seal, which is undesirable. Therefore, there is a need to control the clearance between the blade and the blade outer air seal in order to increase the efficiency of the gas turbine engine.

SUMMARY

In one exemplary embodiment, a support assembly for a gas turbine engine includes a control ring that extends about a circumferential axis. A plurality of first supports has a cavity that receives the control ring. A plurality of cover plates are attached to the first plurality of supports and enclose the cavity.

In a further embodiment of the above, the plurality of first supports includes a plurality of segments that form a circumferential ring.

In a further embodiment of any of the above, the plurality of cover plates form a circumferential ring corresponding to the plurality of first supports.

In a further embodiment of any of the above, a first retention member attaches each of the plurality of cover plates to a corresponding one of the plurality of first supports.

In a further embodiment of any of the above, the first retention member includes a bayonet attachment on a radially outer edge of each of the plurality of cover plates.

In a further embodiment of any of the above, a second retention member includes a tab on a radially inner edge of each of the plurality of cover plates.

In a further embodiment of any of the above, a second support is located radially outward from each of the plurality of first support.

In a further embodiment of any of the above, the second support includes a plurality of cover plate tabs that extend radially inward from an axially extending portion for engaging a first retention member.

In a further embodiment of any of the above, the plurality of cover plates and the inner support are made of the same material.

In another exemplary embodiment, a gas turbine engine includes a control ring that extends about a circumferential axis. A plurality of first supports has a cavity that receives the control ring. A plurality of cover plates are attached to the first plurality of supports and enclose the cavity. A blade outer air seal is attached to at least one of the plurality of first supports.

In a further embodiment of any of the above, the plurality of first supports includes a plurality of segments that form a circumferential ring. The plurality of cover plates form a circumferential ring that correspond to the plurality of first supports.

In a further embodiment of any of the above, a first retention member attaches each of the plurality of cover plates to a corresponding one of the plurality of first supports. The first retention member includes a bayonet attachment on a radially outer edge of each of the plurality of cover plates.

In a further embodiment of any of the above, a second retention member includes a tab on a radially inner edge of each of the plurality of cover plates.

In a further embodiment of any of the above, a second support is located radially outward from each of the plurality of first support.

In a further embodiment of any of the above, the second support includes a plurality of cover plate tabs that extend radially inward from an axially extending portion for engaging a first retention member.

In another exemplary embodiment, a method of controlling radial growth in a gas turbine engine includes locating a unitary control ring around an axis of the gas turbine engine. The control ring is positioned within a cavity defined by a plurality of first supports and a plurality of cover plates.

In a further embodiment of any of the above, the plurality of first supports includes a plurality of C-shaped segments that form a circumferential ring. The plurality of cover plates include a plurality of segments that form a circumferential ring that corresponds to the circumferential ring formed by the plurality of first supports.

In a further embodiment of any of the above, a first retention member attaches each of the plurality of cover plates to a corresponding one of the plurality of first supports. The first retention member includes a bayonet attachment on a radially outer edge of each of the plurality of cover plates.

In a further embodiment of any of the above, a second retention member includes a tab on a radially inner edge of each of the plurality of cover plates.

In a further embodiment of any of the above, the method includes locating the unitary control ring, the plurality of first supports, and the plurality of cover plates adjacent a second support. The second support is located radially outward from each of the plurality of first supports and includes a plurality of cover plate tabs extending radially inward from an axially extending portion for engaging the first retention member.

DETAILED DESCRIPTION

Figure 1:
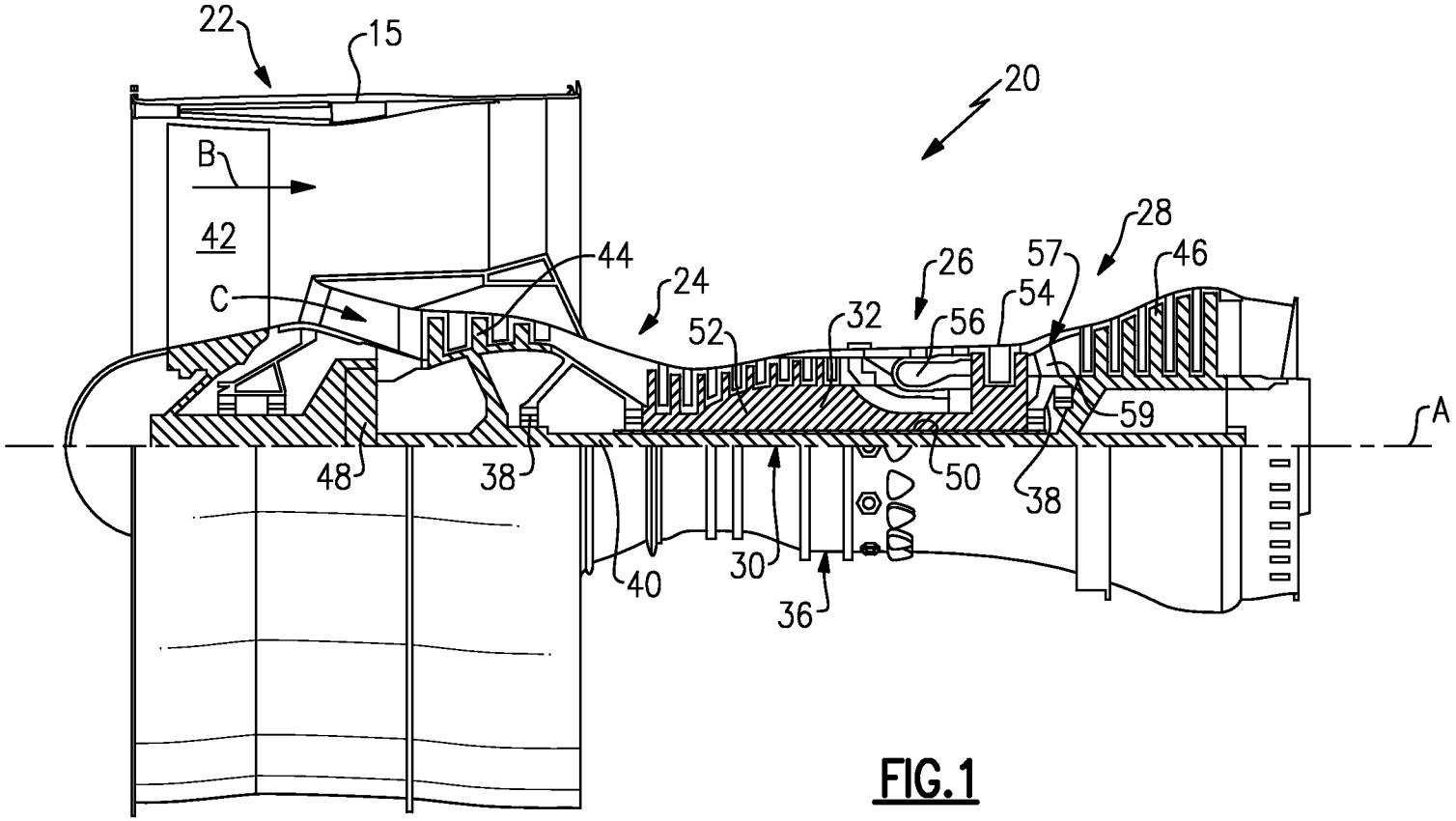
FIG. 1 is a schematic view of an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram } °R)/(518.7° R)]^{0.5}$. The "Low corrected fan tip speed" as disclosed herein according to one non-limiting embodiment is less than about 1150 ft/second (350.5 meters/second).

The example gas turbine engine includes fan 42 that comprises in one non-limiting embodiment less than about twenty-six (26) fan blades. In another non-limiting embodiment, fan section 22 includes less than about twenty (20) fan blades. Moreover, in one disclosed embodiment low pressure turbine 46 includes no more than about six (6) turbine rotors schematically indicated at 34. In another non-limiting example embodiment low pressure turbine 46 includes about three (3) turbine rotors. A ratio between number of fan blades 42 and the number of low pressure turbine rotors is between about 3.3 and about 8.6. The example low pressure turbine 46 provides the driving power to rotate fan section 22 and therefore the relationship between the number of turbine rotors 34 in low pressure turbine 46 and number of blades 42 in fan section 22 disclose an example gas turbine engine 20 with increased power transfer efficiency.

Although the gas turbine engine 20 shown is a high bypass gas turbine engine, other types of gas turbine engines could be used, such as a turbojet engine.

Figure 2:
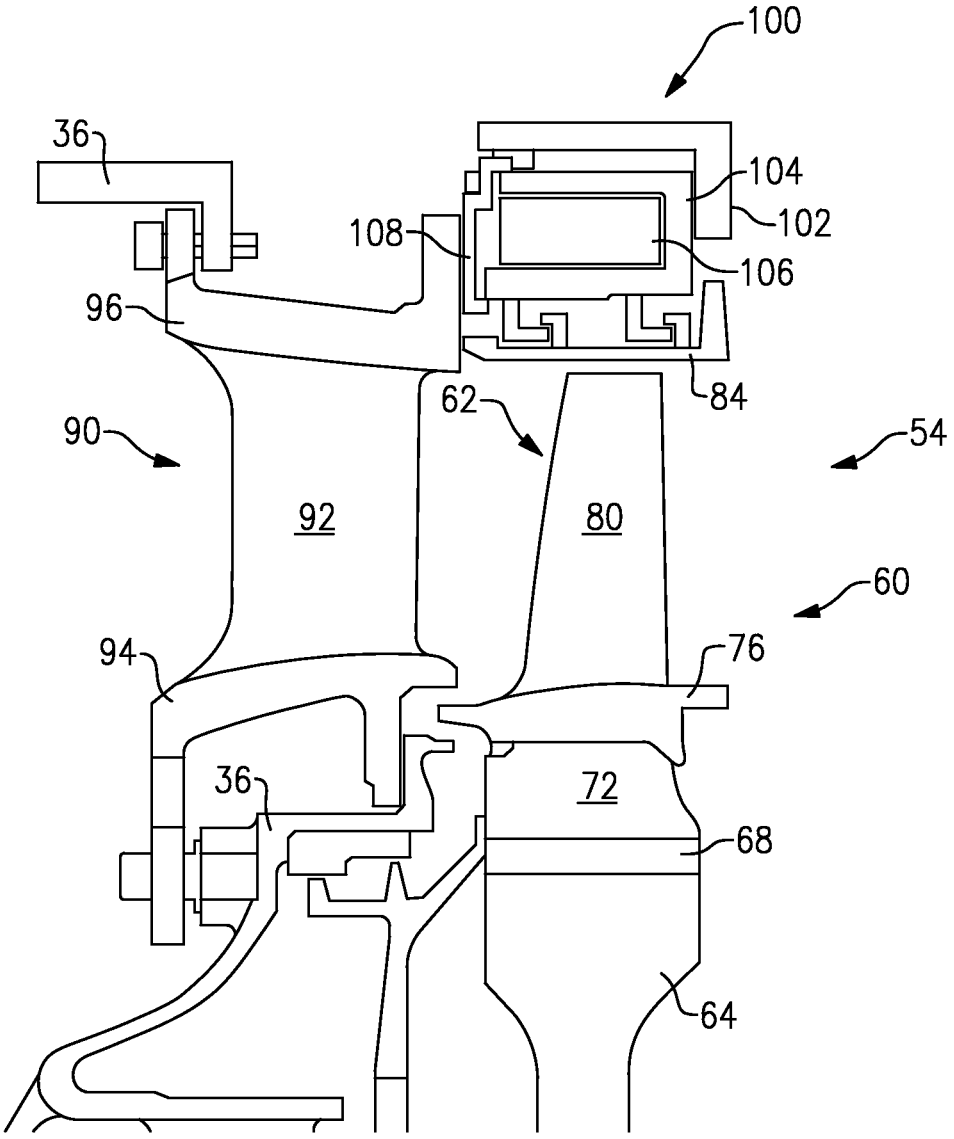
FIG. 2 is a cross-sectional view of a turbine section of the example gas turbine engine of FIG. 1.

FIG. 2 illustrates an enlarged schematic view of the high pressure turbine 54, however, other sections of the gas turbine engine 20 could benefit from this disclosure, such as the compressor section 24. In the illustrated example, the high pressure turbine 54 includes a one-stage turbine section with a first rotor assembly 60. In another example, the high pressure turbine 54 could include a two-stage high pressure turbine section.

The first rotor assembly 60 includes a first array of rotor blades 62 circumferentially spaced around a first disk 64. Each of the first array of rotor blades 62 includes a first root portion 72, a first platform 76, and a first airfoil 80. Each of the first root portions 72 is received within a respective first rim 68 of the first disk 64. The first airfoil 80 extends radially outward toward a first blade outer air seal (BOAS) assembly 84. The BOAS 84 is supported by a support assembly 100.

The first array of rotor blades 62 are disposed in the core flow path that is pressurized in the compressor section 24 then heated to a working temperature in the combustor section 26. The first platform 76 separates a gas path side inclusive of the first airfoils 80 and a non-gas path side inclusive of the first root portion 72.

An array of vanes 90 are located axially upstream of the first array of rotor blades 62. Each of the array of vanes 90 include at least one airfoil 92 that extend between a respective vane inner platform 94 and an vane outer platform 96. In another example, each of the array of vanes 90 include at least two airfoils 92 forming a vane double. The vane outer platform 96 of the vane 90 may at least partially engage the BOAS 84.

Figure 3:
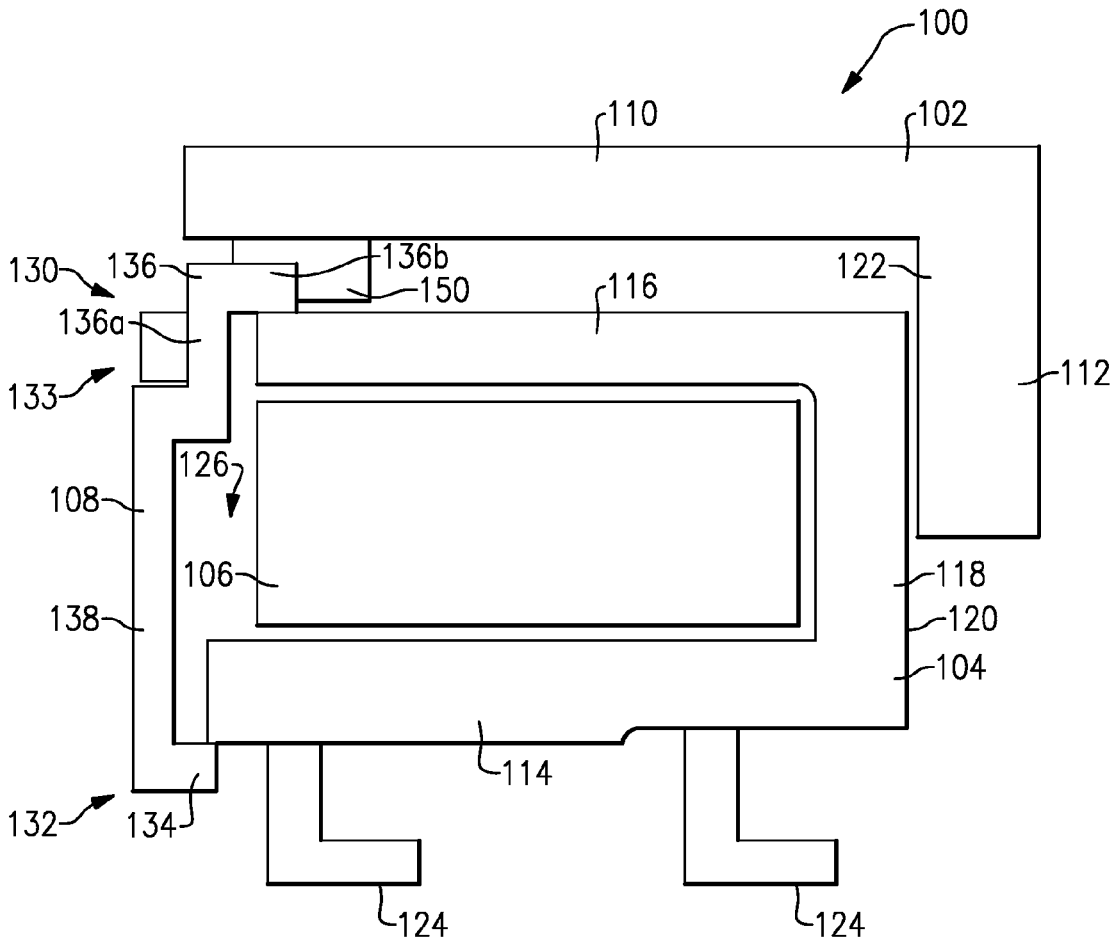
FIG. 3 is a cross-sectional view of an example support assembly for a blade outer air seal.

As shown in FIGS. 2 and 3, the support assembly 100 includes an outer support 102, an inner support 104, a control ring 106, and a cover plate 108. The outer support 102 forms a complete unitary hoop and includes an axially extending flange 110 and a radially extending flange 112. The axially extending flange 110 engages a case or a portion of the engine static structure 36 when installed in the gas turbine engine 20. The radially extending portion of the outer support 102 extends radially inward from the axially extending flange 110. In this disclosure, radially or radially extending is in relation to the engine axis A of the gas turbine engine 20 unless stated otherwise.

The inner support 104 includes a C-shaped cross section with an opening of the C-shaped cross section facing an axially upstream or forward direction. The C-shaped cross section is formed by a radially inner flange 114 connected to a radially outer flange 116 by a radially extending flange 118. The radially extending flange 118 includes an axial surface 120 that engages or abuts an axial surface 122 on the radially extending flange 112 on the outer support 102 to prevent the inner support 104 from moving axially downstream past the radially extending flange 112.

The radially outer flange 116 is spaced radially inward from the axially extending flange 110 on the outer support 102 such that a clearance between the axially extending flange 110 and the radially outer flange 116 is maintained during operation of the gas turbine engine 20. By maintaining the clearance between the axially extending flange 110 and the radially outer flange 116, the inner support 104 is allowed to grow radially outward when exposed to elevated operating temperatures during operation of the gas turbine engine 20 without transferring a load to the outer support 102.

In the illustrated example, the radially inner flange 114 includes attachment members 124 that extend radially inward from a radially inner surface of the radially inner flange 114 to support the BOAS 84 as shown in FIGS. 1 and 2. Although the attachment members 124 are shown as a pair of hooks with distal ends pointing axially downstream in the illustrated example, the attachment members 124 could include hooks pointing in opposite directions or more than or less than two hooks.

In the illustrated example, the cover plate 108 is attached to an axially forward end of the inner support 104 to from a cavity 126 that surrounds the control ring 106. Both the inner support 104 and the cover plate 108 are made of corresponding segments that fit together to form a circumferential ring.

In one example, the cover plate 108 and the inner support 104 are made of the same material. By making the cover plate 108 and the inner support 104 of the same material, the thermal growth of the cover plate 108 will closely match the thermal growth of the inner support 104 to ensure that the axial ends of the inner support 104 grow at a similar rate in the radial direction. In another example, the cover plate 108 and the inner support 104 are made of dissimilar material to control positioning of the support assembly 100.

Figure 4:
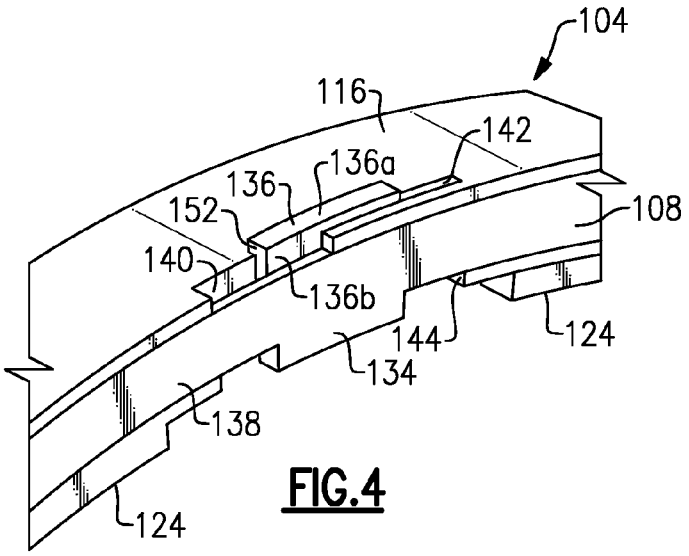
FIG. 4 is a perspective view of a portion of the support assembly of FIG. 3.

As shown in FIGS. 2-4, the cover plate 108 and the inner support 104 are attached to each other with a first retention member 130 and a second retention member 132. In the illustrated example, the first retention member 130 includes a bayonet attachment portion 133 on a radially outer edge of the cover plate 108 and the second retention member 132 includes a tab 134 on a radially inner edge of the cover plate 108. The tab 134 extends in an axially downstream direction. The first retention member 130 and the second retention member 132 allow for radial load transfer between the cover plate 108 and the inner support 104.

The bayonet attachment portion 133 includes a hook portion 136 having a radially extending portion **136*a* that is axially offset from a body portion 138 of the cover plate 108. The radially outer flange 116 of the inner support 104 includes a recess 140 for accepting the hook portion 136 and a groove 142 at least partially axially aligned with the recessed 140 and circumferentially offset such that the cover plate 108 can be rotated in a circumferential direction to move the hook portion 136 from the recessed 140 into the groove 142. The radially extending portion 136*a* of the hook portion 136 engages axial faces of the groove 142 and an axially extending portion 136*b* of the hook portion 136 engages a radially outer surface of the radially outer flange 116**.

The tab 134, which forms the second retention member 132, is located on a radially inner edge of the cover plate 108. The tab 134 engages a radially inner surface of the radially inner flange 114 on the inner support 104 such that the bayonet attachment portion 133 and the tab 134 surround the inner support 104.

Opposing ends of the cover plate 108, which are circumferentially spaced from the first retention member 130 and the second retention member 132, fit within the inner support 104. As shown in FIGS. 3 and 4, the opposing ends of the cover plate 108 contact a radially inner surface of the radially outer flange 116 and a radially inner edge of the cover plate 108 contacts a radially outer surface of the radially inner flange 114.

During assembly of the support assembly 100, the plurality of inner supports 104 are arranged in a circumferential ring surrounding the control ring 106 with the control ring 106 located in the cavity 126. Each of the corresponding plurality of cover plates 108 is placed on the inner support 104 such that the hook portion 136 on each of the plurality of cover plates 108 is located within the corresponding recess 140 in each of the plurality of inner supports 104.

When the plurality of cover plates 108 are located on the inner supports 104, the plurality of cover plates 108 are rotated in unison such that the hook portion 136 on each of the plurality of cover plates 108 moves into the corresponding grooves 142 on each of the inner supports 104. When each of the plurality of cover plates 108 is initially placed in the grooves 142 of the inner support 104, one of the circumferential ends of each of the plurality of cover plates 108 will overlap an adjacent inner support 104. As the plurality of cover plates 108 rotate, each of the plurality of cover plates 108 will circumferentially align with a corresponding one of the inner supports 104. The plurality of cover plates 108 are prevented from rotating further by a stop 144 on the inner support 104 that engages the tab 134.

The inner supports 104, the control ring 106, and the plurality of cover plates 108 are then placed within the outer support 102 such that the axial surface 120 on the inner support 104 contacts or is in close proximity to the axial surface 122 on the outer support 102. A plurality of cover plate tabs 150 extend from a radially inner surface of the axially extending flange 110 of the outer support 102 and engage an edge 152 on each of the hook portions 136 to prevent each of the cover plates 108 from rotating out of the groove 142 after being installed into the outer support 102.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A support assembly for a gas turbine engine comprising:

a control ring extending about a circumferential axis;

a plurality of first supports having a cavity receiving the control ring;

a plurality of cover plates attached to the plurality of first supports enclosing the cavity; and a second support located radially outward from each of the plurality of first supports, wherein the second support includes a plurality of cover plate tabs extending radially inward from an axially extending portion for engaging a first retention member.

2. The assembly of claim 1, wherein the plurality of first supports include a plurality of segments forming a circumferential ring.

3. The assembly of claim 2, wherein the plurality of cover plates form a circumferential ring corresponding to the plurality of first supports.

4. The assembly of claim 1, wherein the first retention member attaches each of the plurality of cover plates to a corresponding one of the plurality of first supports.

5. The assembly of claim 4, wherein the first retention member includes a bayonet attachment on a radially outer edge of each of the plurality of cover plates.

6. The assembly of claim 4, further comprising a second retention member including a tab on a radially inner edge of each of the plurality of cover plates.

7. The assembly of claim 1, wherein the plurality of cover plates and the plurality of first supports are made of the same material.

8. A gas turbine engine comprising:

a control ring extending about a circumferential axis;

a plurality of first supports having a cavity receiving the control ring;

a plurality of cover plates attached to the plurality of first supports enclosing the cavity;

a first retention member attaching each of the plurality of cover plates to a corresponding one of the plurality of first supports, the first retention member includes a bayonet attachment on a radially outer edge of each of the plurality of cover plates; and a blade outer air seal attached to at least one of the plurality of first supports.

9. The gas turbine engine of claim 8, wherein the plurality of first supports include a plurality of segments forming a circumferential ring and the plurality of cover plates form a circumferential ring corresponding to the plurality of first supports.

10. The gas turbine engine of claim 8, further comprising a second retention member including a tab on a radially inner edge of each of the plurality of cover plates.

11. The gas turbine engine of claim 8, further comprising a second support located radially outward from each of the plurality of first supports.

12. The gas turbine engine of claim 11, wherein the second support includes a plurality of cover plate tabs extending radially inward from an axially extending portion for engaging the first retention member.

13. A method of controlling radial growth in a gas turbine engine comprising:

locating a unitary control ring around an axis of the gas turbine engine;

positioning the control ring within a cavity defined by a plurality of first supports and a plurality of cover plates; and a first retention member attaching each of the plurality of cover plates to a corresponding one of the plurality of first supports, the first retention member includes a bayonet attachment on a radially outer edge of each of the plurality of cover plates.

14. The method of claim 13, wherein the plurality of first supports include a plurality of C-shaped segments forming a circumferential ring and the plurality of cover plates include a plurality of segments that form a circumferential ring that corresponds to the circumferential ring formed by the plurality of first supports.

15. The method of claim 13, further comprising a second retention member including a tab on a radially inner edge of each of the plurality of cover plates.

16. The method of claim 15, further comprising locating the unitary control ring, the plurality of first supports, and the plurality of cover plates adjacent a second support, the second support is located radially outward from each of the plurality of first supports and includes a plurality of cover plate tabs extending radially inward from an axially extending portion for engaging the first retention member.

* * * * *